United States Patent [19]

Hacker

[11] 4,151,365

[45] Apr. 24, 1979

[54] FILLED SERVICE CABLE HAVING CORRUGATED SHIELD AND METHODS OF MAKING

[75] Inventor: Joseph M. Hacker, Fallston, Md.

[73] Assignee: Western Electric Company, Inc., New York, N.Y.

[21] Appl. No.: 826,600

[22] Filed: Aug. 22, 1977

[51] Int. Cl.[2] ..... H01B 7/20; H01B 11/06; H01B 13/24; H01B 13/26

[52] U.S. Cl. ..... 174/107; 156/54; 174/102 D

[58] Field of Search ..... 174/107, 102 D, 106 D, 174/102 R; 29/624, 728, 745, 819, 820; 156/51, 52, 53, 54, 56

[56] References Cited

U.S. PATENT DOCUMENTS

| | | | |
|---|---|---|---|
| 2,090,744 | 8/1937 | Boe | 174/102 D |
| 3,087,007 | 4/1963 | Jachimowicz | 156/54 X |
| 3,272,912 | 9/1966 | Jachimowicz | 174/107 |
| 3,803,340 | 4/1974 | Jachimowicz | 174/107 |

FOREIGN PATENT DOCUMENTS

| | | | |
|---|---|---|---|
| 910072 | 4/1942 | Fed. Rep. of Germany | 174/107 |
| 968061 | 8/1964 | United Kingdom | 174/107 |

*Primary Examiner*—Laramie E. Askin
*Attorney, Agent, or Firm*—E. W. Somers

[57] ABSTRACT

A cable comprises a plurality of insulated conductors enclosed in a corrugated metallic shield jacketed with a plastic material. As a corrugated metallic tape is wrapped longitudinally about the core to form the shield, overlapping longitudinal edge portions of the shield are intentionally spaced apart radially. When the plastic jacket is extruded over the shield, a portion of the plastic material extends between the overlapped but spaced apart longitudinal edge portions. This prevents lock-in of the corrugations along the overlapped edge portions and provides the cable with an additional degree of freedom of movement so that the cable can withstand placement stresses caused by sharp radius bending during installation without shield separation or cracking.

3 Claims, 13 Drawing Figures

FILLED SERVICE CABLE HAVING CORRUGATED SHIELD AND METHODS OF MAKING

BACKGROUND OF THE INVENTION

1. Field of the Invention

This invention relates to the reduction of stresses in a corrugated cable shield, and, more particularly, to a shielded cable capable of withstanding forces imparted to the shield when the cable is installed.

2. Prior Art

Filled service cable, in general, comprises a core having a plurality of pairs of individually insulated conductors in which the interstices between the conductors are filled with a waterproofing compound, and a polyester material which is wrapped about the core. By a process known as armoring, a corrugated metallic tape is wrapped longitudinally about the filled, wrapped core to form a shield having an overlapped seam with the corrugations of the overlapped seam portions being nested together. A vinly chloride polymer material is extruded over the shield to form a jacket having an outside diameter on the order of 0.280 to 0.350 inch. Such a cable is shown, for example, in U.S. Pat. No. 3,885,380 which issued on May 27, 1975 in the name of J. M. Hacker.

Typically, filled service cables extend underground between distribution cables and customers' premises and are installed by means of a plow having a vibratory cutting blade which is referred to as a plow share. As the plow share is vibrated, the cable is moved through a tube attached to the blade and into a trench along a curved path having a sharp radius which may be on the order of one to two inches. The corrugations of the shield on the outside of the bend in the cable undergo tension tending to flatten out the corrugations, while the corrugations on the inside are subject to compression thereby tending to cause cracking and separation of the cable shield. This may occur because the nested, registered corrugations restrict relative motion between the overlapping edges of the shield. Once the shield becomes cracked or separated, torsional shear and longitudinal forces which continue to be imparted to the cable during installation cause the jacket to thin down in the vicinity of each crack or separation and render the cable vulnerable to damage brought on by rodent attack or by mechanical forces imparted to underground cables.

The cable is prestressed during its manufacture when it may be twisted in a clockwise or counter-clockwise direction depending on the shield material, on the characteristics of the shield-forming apparatus, and on how it is moved off the manufacturing line. The stresses imparted to the cable during manufacture may be increased during its handling and installation. For example, in the field, a reel of cable is rested on the radial face of one of its flanges and the cable convolutions then pulled over the other flange. Since only the trailing end of the cable on the reel is accessible, the cable could be pulled off the reel in a manner which would impart a twist opposite to that direction of twist imparted during manufacture, thereby increasing the stresses in the cable.

In service cables made in accordance with the prior art, the overlapping nested portions of the corrugated shield may be moved in opposite circumferential directions since an amount of movement is possible between the overlapping shield portions and the plastic jacket without the plastic being torn or the plastic being torn from the shield. However, since the overlapping portions of the shield are nested and hence locked together, relative movement of the overlapping shield portions in the longitudinal direction is prevented and forces such as those experienced during installation cause cracking or separation of the shield.

The problem of degradation of the cable occurring during the installation of the cable can be avoided by manufacturing a cable having freedom of movement in a direction longitudinally of the cable between overlapping portions of the corrugated shield. Although this can be accomplished by forming the shield from a non-corrugated metallic tape, such a cable could not be flexed sufficiently along a sharp radius curved path such as those met in underground installations and could crack. The use of a jacket comprising a highly stress-resistant material such as, for example, polyethylene is also not a viable alternative because of the flame retardance requirements for jacketing materials of products used adjacent customers' premises.

Nowhere has the prior art recognized the problem of degradation of cables brought on by excessive stresses when overlapping nested corrugations of the shield cannot move relative to each other in a longitudinal direction as the cable is advanced in a sharp radius bend in an underground installation. At best, the prior art has recognized and dealt with the problem of seam separation during cooling of the cable jacket such as, for example in U.S. Pat. No. 3,272,912 where a polyethylene jacket shrinks and causes overlapping edge portions of a shield to slide relative to each other to reduce the original cross-sectional shape.

SUMMARY OF THE INVENTION

A cable which is produced in accordance with this invention comprises a core having a plurality of insulated conductors, a corrugated metallic shield wrapped longitudinally about the core with the edges forming an overlapped seam, and a jacket of a polymeric material surrounding the corrugated metallic shield. In accordance with one aspect of the invention, the longitudinal overlapping edges of the shield are moved apart radially and a spacer such as, for example, a portion of the polymeric material, extends between the overlapping, but separated portions of the shield, thereby affording a degree of freedom between the overlapping edge portions in the longitudinal direction and permitting the cable to yield when it is moved along a curved path.

In accordance with another aspect of the invention, a method of making a jacketed cable which comprises a core, a corrugated metallic shield enclosing the core and a jacket of plastic material surrounding the shield, and which is capable of withstanding forces imparted to the cable when it is advanced along a sharp radius path, includes advancing a core comprising a plurality of individually insulated conductors, wrapping a corrugated metallic tape longitudinally about the core to form a tubular shield with longitudinal edge portions of the shield being overlapped, spacing apart radially the overlapped longitudinal edge portions of the shield, and covering the shield with a plastic material such that a portion of the plastic material is moved between the spaced apart longitudinal edge portions of the shield.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
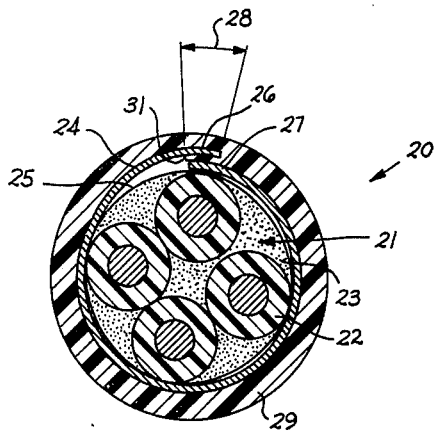
FIG. 1 is an enlarged end sectional view of a cable constructed in accordance with the principles of this invention.

A cable 20 constructed in accordance with the principles of this invention is shown in FIG. 1. The cable 20 includes a core, designated generally by the numeral 21. The core 21 is comprised of a plurality of insulated conductors 22—22 each of which includes a conductive element, typically drawn copper or aluminum or alloys thereof, insulated with a plastic material such as, for example, polyethylene. The interstices between the conductors 22—22 are filled with a flame retardant, waterproofing compound 23 such as, for example, that disclosed in U.S. Pat. No. 3,944,717 issued Mar. 16, 1976, in the names of Hacker et al. The filling of the cable 20 may be accomplished by the methods shown in previously identified U.S. Pat. No. 3,885,380.

The conductors 22—22 and waterproofing compound 23 are enclosed by a polyester envelope 25 and a corrugated metallic shield 24. The shield 24 is used for grounding electrically the cable 20 and for providing mechanical protection for the conductors 22—22. The shield 24 typically is made of aluminum, but may be made from other metals. Longitudinal edge portions 26 and 27 of the shield 24 are overlapped to form a seam 28.

The completed cable 20 shown in FIG. 1 includes a jacket 29 of a polymeric material extruded over the shield 24. Preferably, the composition of the jacket 29 is a flame retardant polyvinyl chloride (PVC) composition, which fills the valleys of the corrugations. In prior art service cables, the pressure extrusion of the vinyl polymer material about the shielded core 21 moves the overlapping edge portions 26 and 27 of the corrugated metallic shield 24 into engagement with each other and causes the registered corrugations to be nested and locked together.

Figure 2:
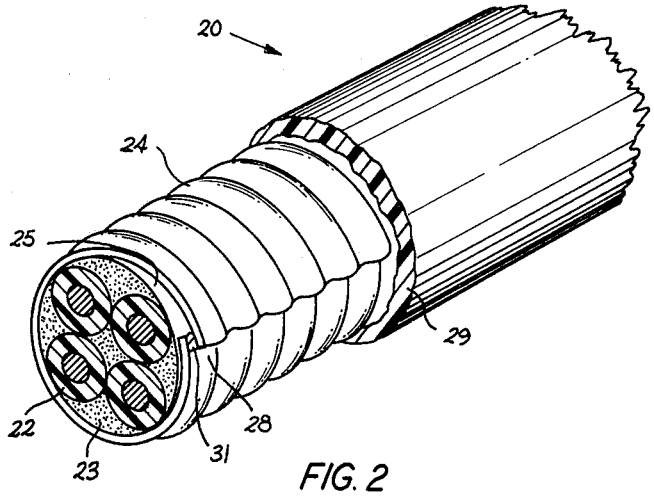
FIG. 2 is a perspective view of the cable shown in FIG. 1.

As can be seen in FIGS. 1 and 2, the cable 20, which embodies the principles of this invention, includes a shield 24 having intentionally spaced apart longitudinal edge sections with an intrusion 31 of the vinyl polymer material having been extruded between the overlapping portions. The intrusion 31 of the vinyl chloride polymer material is continuous along the length of the cable 20 and is integral with the vinyl chloride polymer material which comprises the jacket 29.

Advantageously for this particular type of cable and its use, the overlapping corrugated edge portions 26 and 27 are not locked together. Since the overlapping edge portions 26 and 27 are not locked together, a troublesome degree of constraint is effectively removed. The interposing of the plastic intrusion 31 in engagement with the inwardly facing surface of the longitudinal edge portion 26 and with the outwardly facing surface of the longitudinal edge portion 27 permits movement of the longitudinal edge portions in the direction of the longitudinal axis of the cable 20. The cable shield 24 is thus provided with an additional degree of freedom of movement.

Figure 3:
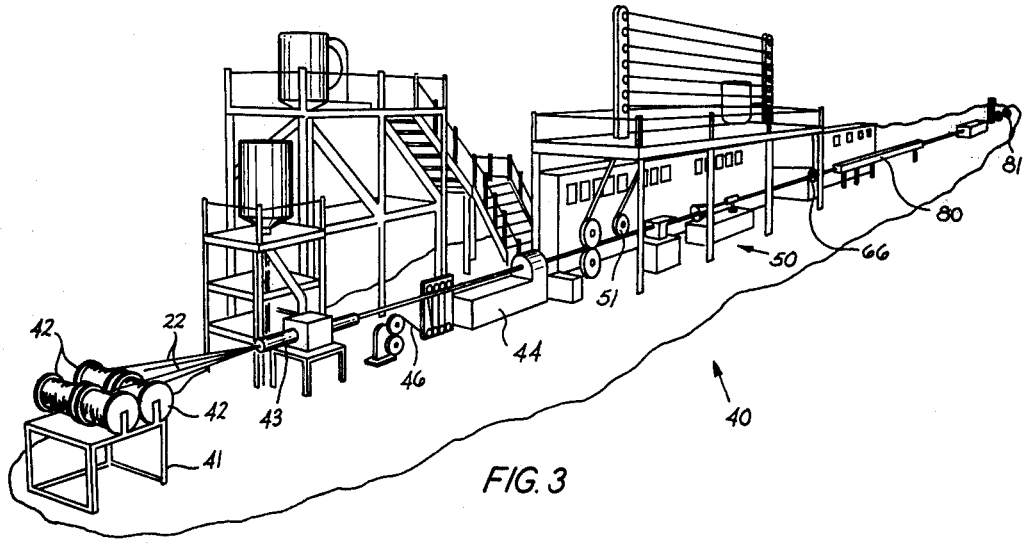
FIG. 3 is a perspective view of a manufacturing line which is used to construct the cable shown in FIG. 1.

Manufacturing apparatus, designated generally by the numeral 40, for making the cable 20 is shown in FIG. 3. Beginning at the left hand end of the apparatus 40, as viewed in FIG. 3, there is a stand 41 for supporting a plurality of supply reels 42—42 of the insulated conductors 22—22.

The conductors 22—22 are moved through a chamber 43 such as that disclosed and claimed in priorly identified U.S. Pat. No. 3,885,380. The movement of the twisted conductors 22—22 through the chamber 43 causes the conductors to be well exposed to the waterproofing compound 23 and then to be reclosed into the configuration of the core 21. The interstices and the surface openings in the resulting cable core 21 are filled with the waterproofing compound 23.

In the next step the filled core 21 is advanced through a device 44 which applies a tape 46, made of a polyester material, about the core to form the envelope 25. Then the device 44 wraps a binder (not shown) about the envelope 25. The polyester envelope 25 and the binder and their application to the cable core 21 are well known in the cable art. See, for example, U.S. Pat. No. 3,420,720.

Figures 4, 6:
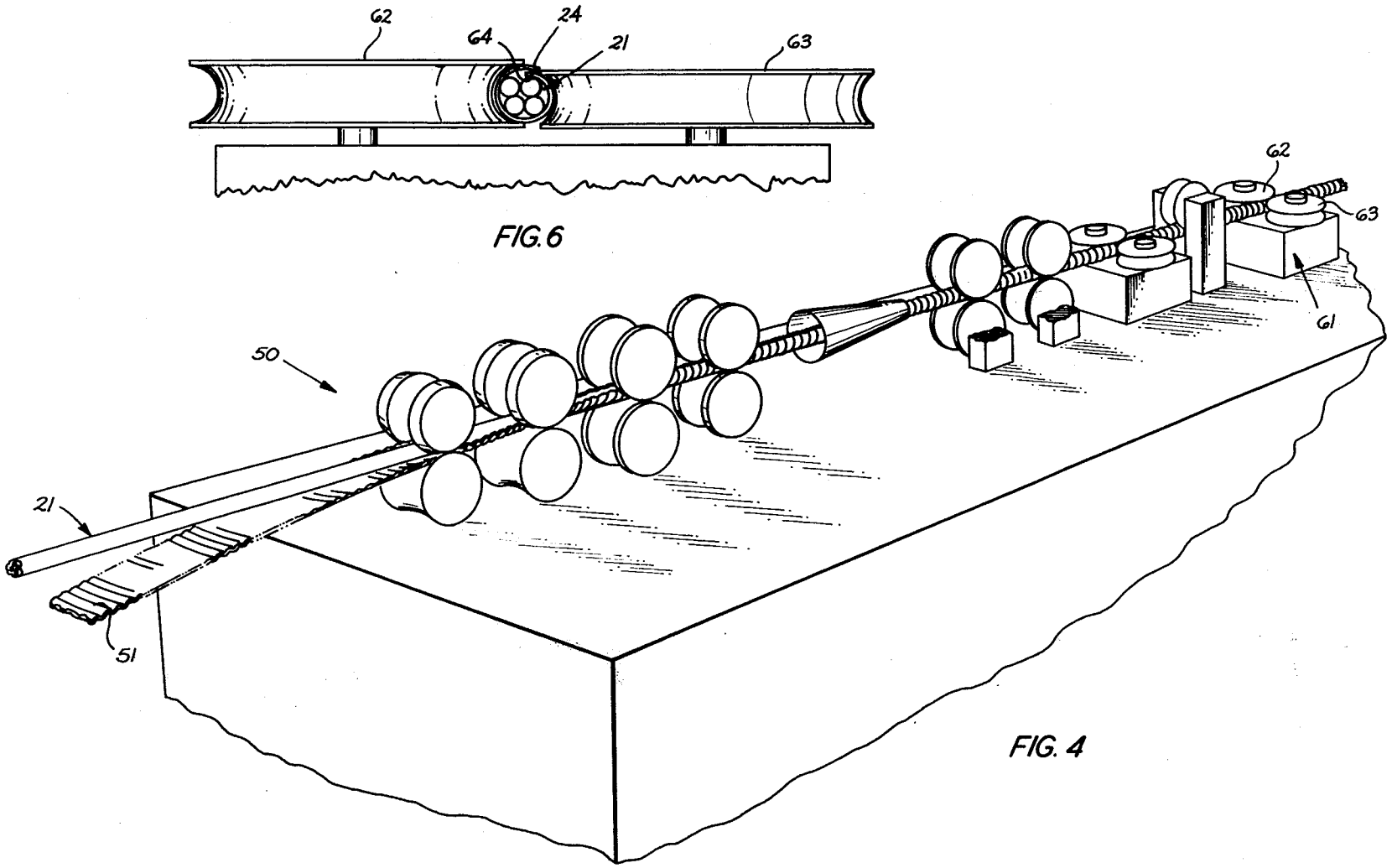
FIG. 4 is an enlarged perspective view of a portion of the manufacturing line shown in FIG. 3 used to form a metallic tape into a shield enclosing a filled core of the cable.
FIG. 6 is an enlarged elevational view of a portion of the apparatus shown in FIG. 4 used to separate intentionally overlapping edge portions of the shield.

Then the filled core 21 is advanced in a downstream direction to the right as viewed in FIG. 3 through a forming mill, designated generally by the numeral 50 (see FIG. 4), for wrapping a metallic tape 51 longitudinally about the core 21 to form the shield 24. The tape 51 is transversely corrugated and is wrapped in steps (see FIGS. 5A, 5B and 5C) about the core 21 with longitudinal edge portions 26 and 27 being overlapped in a generally contiguous relationship to form the seam 28. The forming mill 50 includes a plurality of sets of coacting rollers, each roller of each set being formed generally to the contour of half the cable cross-section.

In the field, the cable 20 tends toward a configuration with the seam 28 being spiralled 180° about every ten feet. During placement of the cable 20, forces are imparted to the cable which produce torsional shear and other stresses. These stresses tend to realign the seam 28 with the longitudinal axis of the cable. Since the shield 24 is corrugated, the overlapping seam portions 26 and 27 are registered together such that any longitudinal movement between overlapping seam portions is prevented.

During the installation of filled service cables, constructed without the benefit provided by the intrusion 31, a necking down of the cable has been observed. The removal of the cable jacket 29 in a necked down portion of the cable 20 has revealed a separation circumferentially of the shield for a distance of about one to three inches. This disadvantageously leaves a length of the core 21 protected only by the necked down cable jacket 29.

The methods of making the cable 20 in accordance with the principles of this invention overcomes this problem by providing a cable structure having an additional degree of freedom. This is accomplished by spacing apart the overlapping edge portions 26 and 27 of the shield 24. Then, when the cable 20 is subjected to the rigors of installation, including bending along a small radius path, longitudinal movement can occur between the overlapping edge portions of the shield 24. The term "small radius path" is intended to mean small as compared to the outside diameter of the armored core 21. For example, the outside diameter (O.D.) of the armored core 21 of the particular service cable 20 to which the principles of this invention are currently applied is about 0.270 inch, and the radius about which it is advanced in a widely used plow is about 1.5 inches.

In order to provide the cable 20 with this additional degree of freedom, the cable core 21 having the shield 24 wrapped thereabout is advanced through a portion of the apparatus 50 where the overlapped edge portions 26 and 27 are spaced apart. The forming mill 50 includes a set 61 (see FIGS. 4 and 6) of rollers 62 and 63 for separating intentionally longitudinal overlapping edge portions 26 and 27 of the shield 24. As can best be seen in FIG. 6, the set 61 of rollers 62 and 63 past which the armored core 21 is advanced lastly in the forming mill 50 are arranged with the roller 62 being separated in a horizontal plane slightly higher than the roller 63. This set 61 of rollers 62 and 63 causes a separation of the outwardly and inwardly facing portions 26 and 27 along the seam 28 to form an opening 64. Typically, the seam 28 is oriented upwardly as it is passed between these two rollers 62 and 63.

Figure 7:
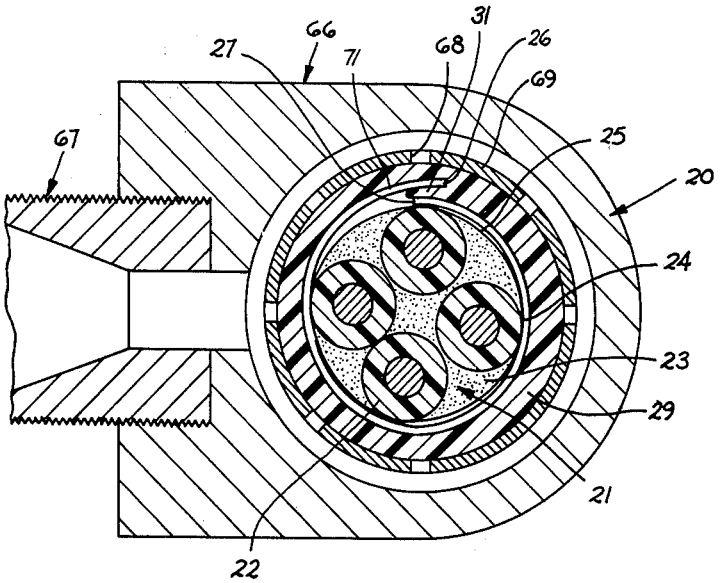
FIG. 7 is an enlarged end view in section as the shielded cable core is advanced through an extruder wherein a jacket of polyvinyl chloride is formed about the shielded core.

Next, the core 21, which is enclosed in the separated eam shield 24, is moved for a distance of about eight to ten feet to an extruder 66 (see FIGS. 3 and 7). The armored core 21 turns about its longitudinal axis as it is advanced through the apparatus 40. When the core 21 and shield 24 enter the extruder 66, the seam 28 is oriented horizontally with the opening 64 between the overlapping portions 26 and 27 being opposite a barrel 67 of the extruder 66.

Figure 8:
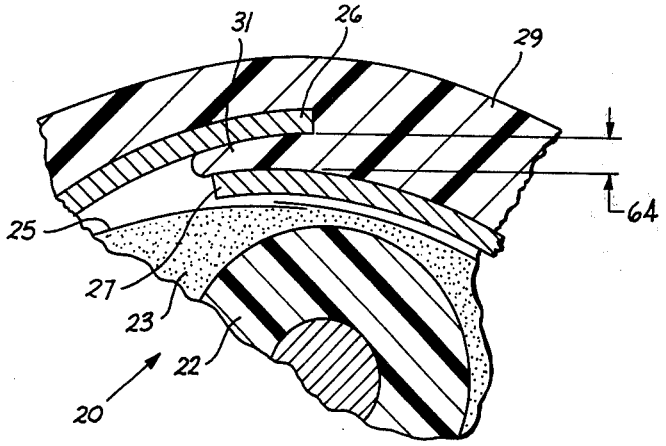
FIG. 8 is an enlarged view of the seam portion of the cable following extrusion of the jacket.

The extruder 66 covers the shield 24 with a plasticized polyvinyl chloride plastic material which flow through openings 68 in a die 69. The polyvinyl chloride material jacket 29 is on the order preferably of at least 25 mils thick and generally is about 37 mils thick. Because of the separation between the overlapping edge portions 26 and 27 of the shield, a portion of the polyvinyl chloride material is moved into the opening 64 as the intrusion 31 to form the cross-sectional shape shown in FIG. 8.

The size of the opening 64 between the overlapping edge portions 26 and 27 formed by the last set 61 of the rollers 62 and 63 in the forming mill 50 is important. As the armored core 21 is advanced through the extruder 66, the vinyl chloride polymer extrudate exerts pressure against the outwardly facing exposed surface of the shield 24 which tends to close the opening 64 formed by the last set 61 of rollers 62 and 63. On the other hand, the movement of the PVC into the seam opening 64 tends to move the outer longitudinal edge portion 26 further outwardly.

Figure 9:
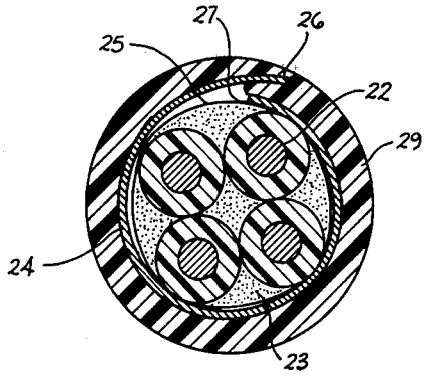
FIG. 9 is an end view of a cable of the type in FIG. 1 in section but showing the result of having separated intentionally the overlapping portions of the seam an excessive amount.
Figure 10:
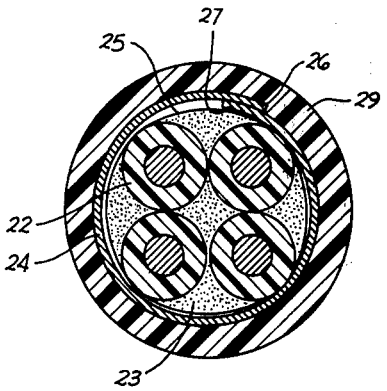
FIG. 10 is an end view of a cable of FIG. 1 in section but showing the result of not having separated the overlapping portions of the seam a sufficient distance.

If the opening 64 is too great, then the intrusion 31 is so large that the forces exerted by it may move the outwardly facing edge portion 26 of the seam 28 into the jacket 29 (see FIG. 9) and result in a thin covering over the free edge portion of the shield 24 which renders the jacket 29 vulnerable to rupture. On the other hand, if the opening 64 is undersized, the forces exerted by the intrusion 31 are overcome by the extrudate forces on the outwardly facing edge portions 26 of the seam 28 which tends to cause the seam 28 to be closed with the corrugations nested and not capable of relative movement in a longitudinal direction. In a preferred embodiment, the distance between the overlapping edge portions 26 and 27 is at least equal to the thickness of the metallic shield 24.

It should be understood that while the invention has been described in terms of an intentional separation of the overlapping longitudinal edge portions, the invention is not so limited. What is important is that the corrugations of the overlapping portions 26 and 27 be separated to order to permit relative movement between the overlapping edge portions in a longitudinal direction. Complete freedom to slide may be ideal. This could be accomplished by separating the overlapping portions and then inserting a spacer, such as, for example, a strip of rigid or semi-rigid material therebetween. The embodiment described hereinbefore does not result in complete freedom to slide. Rather, a plastic material is inserted into the opening 64 to yield and permit movement in the longitudinal direction and to absorb some of the stresses imparted to the shield 24 when the cable 20 is installed.

EXAMPLE

Figure 5A:
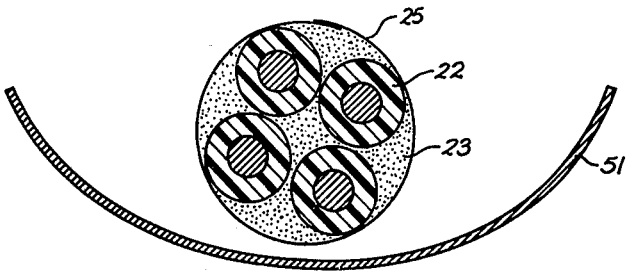
FIGS. 5A, 5B and 5C are cross-sectional end views of the cable at various stages in the forming of the shield.
Figure 5B:
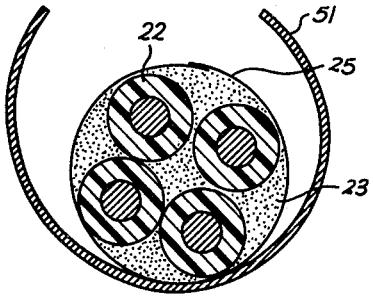
Figure 5C:
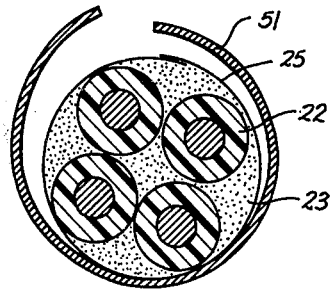

A cable core 21 comprising two pairs of conductors 22—22 having a waterproofing compound 23 applied to the interstices and to the outer periphery of the core is advanced at a line speed of about 400 fpm through the forming mill 50. A 0.656 inch wide tape 51 made from 0.005 inch thick sheet corrugated bronze is advanced from the supply into the forming mill 50. The tape 51 is corrugated typically with corrugations having on amplitude of about 0.012 inch peak to peak and a frequency of about eighteen corrugations per inch. The tape 51 is wrapped longitudinally about the cable core 21 in a sequence of steps in the forming mill 50 to form the shield 24 as shown in FIGS. 5A–5C. The core 21 enclosed with the shield 24 having an overlapping longitudinal seam of about 0.100 inch has an outer diameter of about 0.200 inch.

The shielded or armored cable core 21 is moved between the coacting rollers 62 and 63 which are mounted rotatably on vertical axes spaced apart about 1.5 inches. Each of the rollers 62 and 63 has a curved face which approximates the contour of the formed core 21. Moreover, the rollers 62 and 63 are offset along the vertical axes about 0.010 inch. The rollers 62 and 63 are effective to cause the corrugated shield 24 to separate a minimum distance of about 0.005 inch along the longitudinal seam and generally a distance of about 0.010 inch. The seam 28 is such that the exposed longitudinal edge 26 is oriented vertically.

The shielded cable core 21 is advanced for about eight to ten feet before it enters the extruder crosshead 66. At that time the longitudinal edge 26 is oriented generally horizontally (see FIG. 7) away from the extruder barrel 67 with the opening 64 between the overlapping edge portions facing away from the barrel. The extruder 66 causes a jacket 29 of plasticized polyvinyl chloride to be formed about the armored core 21 in engagement with the corrugated shield 24. Further, the extrudate is caused to be moved between the overlapping portions 26 and 27 of the shield to form an intrusion 31 of plastic material. The jacket thickness is preferably a minimum of about 0.025 inch and generally is on the order of 0.032 inch.

The jacketed core 21 is moved out of the extruder 66, is cooled in a trough 80 (see FIG. 3) containing water having a temperature of about 60° F., and is then taken upon a reel 81.

Figure 11:
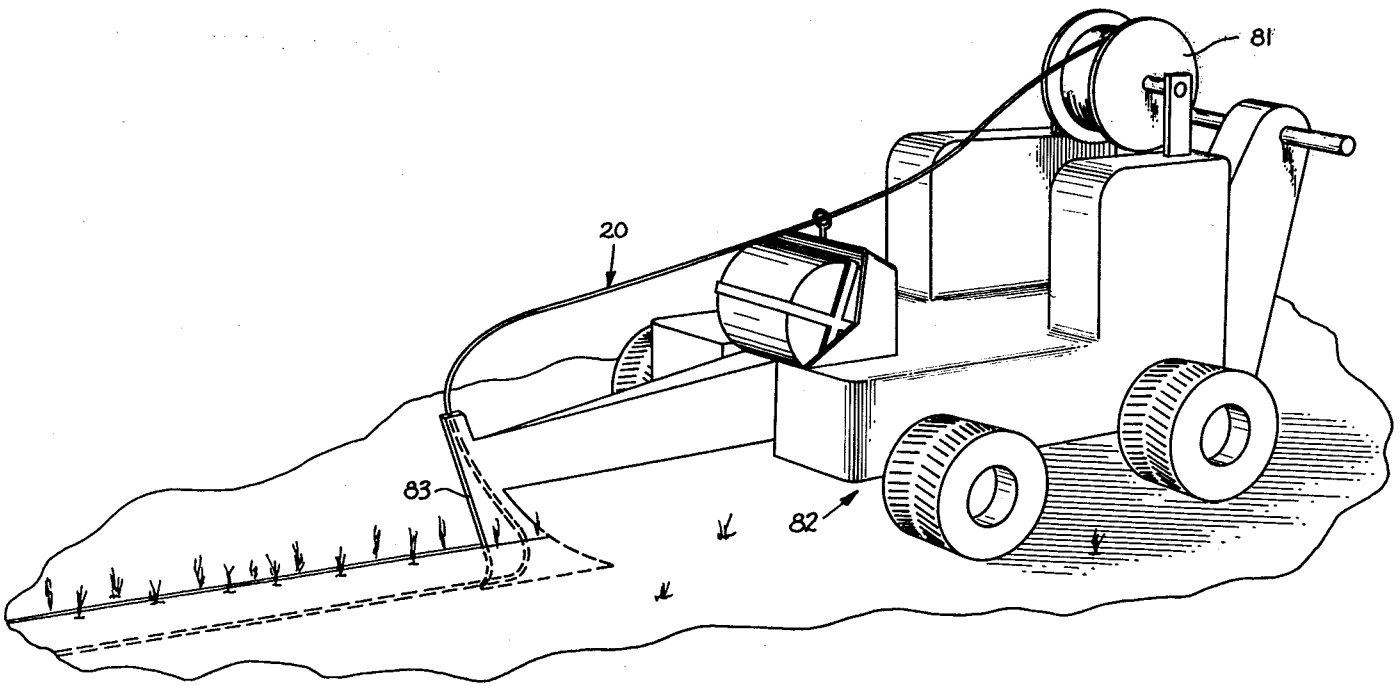
FIG. 11 is a perspective view showing a typical installation of a cable which has been manufactured in accordance with the principles of this invention.

A reel 81 of the cable 20 constructed in accordance with the principles of this invention is mounted on a plow 82 (see FIG. 11) having a vibratory cutting blade 83. As the plow 82 moves along the ground, the vibratory blade 83 cuts a slit in the ground to permit the cable 20 to be advanced through a hollow part in the blade and into the slit. As can be seen in FIG. 11, the movement of the cable 20 out of the blade 83 and into the ground causes the cable to be advanced along a path having a severe bend and which typically is about 1.5 inches. Unlike prior art cables, the cable 20 of this invention does not experience necking down due to armor rupture nor other degrading effects due to torsional and other stresses imparted thereto during installation.

It is to be understood that the above-described arrangements are simply illustrative of the invention. Other arrangements may be devised by those skilled in the art which will embody the principles of the invention and fall within the spirit and scope thereof.

What is claimed is:

1. A method of making a cable in which a core is enclosed in a shield having an overlapped longitudinally extending seam and a jacket of a vinyl chloride polymer material, the method comprising the steps of:

advancing a cable core;

wrapping longitudinally a corrugated metallic tape about the core to form a shield having an overlapped longitudinally extending seam;

radially separating the overlapped longitudinal edge portions of the shield; and extruding a vinyl chloride polymer material about the shield with a portion of the extrudate forming an intrusion of polymeric material having substantially predetermined dimensions between the overlapping edge portions of the shield.

2. The method of claim 1, wherein the separating of the overlapping edge portions forms an opening therebetween which causes the forces exerted by the extrudate on the outwardly facing surface of the outer longitudinal edge portion to be balanced by those on the inwardly facing surface of the outer longitudinal edge portion.

3. A cable which is produced in accordance with the method of claim 1.

* * * * *